US006030184A

United States Patent [19]

Ikeda et al.

[11] Patent Number: 6,030,184

[45] **Date of Patent: *Feb. 29, 2000**

[54] HOUSING CONSTRUCTION FOR RECIPROCATING PISTON TYPE COMPRESSOR

[75] Inventors: Hayato Ikeda, Kariya; Hiromi Michiyuki, Anjo; Hisato Kawamura; Tomoji Tarutani, both of Kariya, all of Japan

[73] Assignee: Kabushiki Kaisha Toyoda Jidoshokki Seisakusho, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/617,398

[22] Filed: Mar. 18, 1996

[30] Foreign Application Priority Data

Mar. 23, 1995 [JP] Japan ..... 7-064579

[51] Int. Cl.[7] ..... F04B 1/12

[52] U.S. Cl. ..... 417/269; 417/312

[58] Field of Search ..... 417/269, 222.1, 417/222.2, 540, 312; 418/149

[56] References Cited

U.S. PATENT DOCUMENTS

| | | | |
|---|---|---|---|
| 3,269,373 | 8/1966 | Baumler et al. | 418/149 |
| 4,416,190 | 11/1983 | Ishizuka | 417/269 |
| 4,990,064 | 2/1991 | Ikeda et al. | 417/269 |
| 5,207,563 | 5/1993 | Ikeda et al. | 417/269 |
| 5,397,218 | 3/1995 | Fujii et al. . | |
| 5,433,137 | 7/1995 | Ikeda et al. . | |
| 5,456,158 | 10/1995 | Ikeda et al. | 417/269 |
| 5,556,261 | 9/1996 | Kimura et al. . | |

FOREIGN PATENT DOCUMENTS

| | | |
|---|---|---|
| 1196777 | 7/1965 | Germany . |
| 1958029 | 5/1971 | Germany . |
| 3407321 | 9/1984 | Germany . |
| 4326366 | 2/1994 | Germany . |
| 4404637 | 8/1994 | Germany . |
| 19523157 | 1/1996 | Germany . |
| 5688974 | 7/1981 | Japan . |
| 5085908 | 12/1994 | Japan . |

*Primary Examiner*—Ted Kim

*Attorney, Agent, or Firm*—Morgan & Finnegan, L.L.P.

[57] ABSTRACT

A compressor is described having a pair of casings fastened together by a plurality of bolts. A piston is located for reciprocation within a cylinder bore formed in the casings. A cam plate is mounted on a rotary shaft supported by the casings to reciprocate the piston. The cam plate is held by the casings between a pair of thrust bearings. The casings include adjoining surfaces fitted to each other and a member sandwiched between the adjoining surfaces of the casings for absorbing dimensional tolerances of the casings, cam plate and thrust bearings according to the deformation of the member.

20 Claims, 3 Drawing Sheets

HOUSING CONSTRUCTION FOR RECIPROCATING PISTON TYPE COMPRESSOR

BACKGROUND OF THE INVENTION

1. Field of the Invention

The present invention relates to a reciprocating piston type compressor used in a vehicle air-conditioning system, and more particularly, to a compressor housing construction.

2. Description of the Related Art

There are two typical types of reciprocating piston type compressors. The first type compresses refrigerant gas in a bore with one end, or head, of a piston while the second type compresses gas with both ends, or both heads, of a piston.

A compressor employing double-headed reciprocating pistons typically has a pair of cylinder blocks fastened to each other by a plurality of bolts. A plurality of bores is formed in each cylinder block at aligned positions with a predetermined space defined between them. A reciprocal double-headed piston is located in each pair of aligned bores. A swash plate is mounted on a rotary shaft between the two blocks to reciprocate the pistons. A pair of thrust bearings enables the swash plate to rotate with respect to the cylinder blocks.

In this prior art compressor, the bearing races are deformed when the bolts are tightened to secure the cylinder blocks to each other. The deformation of the bearing races absorbs dimensional tolerance of the two cylinder blocks, the swash plate, and the two thrust bearings in the axial direction.

However, since rotating bodies, such as balls or rollers are retained by the bearing races, deformation of the races is undesirable for smooth rotation of the rotating body, that is, smooth rotation of the bearings. A large amount of deformation will interfere with smooth rotation of the bearing and causes an increase in power loss. Thus, in conventional compressors, a large deformation of the bearing races results in low supporting rigidity of the swash plate and vibration and noise during operation. Generation of vibration and noise in the compressor may lead to resonance with other parts of the vehicle and amplify the noise.

In an attempt to overcome this problem in the prior art, various swash plates, cylinder blocks, and thrust bearings having different axial dimensions were selected and assembled to one another to offset the dimensional tolerance between each component. However, assembly of the compressor was burdensome and resulted in an increase in manufacturing costs.

SUMMARY OF THE INVENTION

It is an objective of the present invention to provide a reciprocating piston type compressor that absorbs dimensional tolerances to suppress vibration and noise while also having a simplified structure to reduce manufacturing costs.

Basically, a compressor according to the present invention has a pair of casings fastened together by a plurality of bolts. A piston is adapted for reciprocation within a cylinder bore formed in at least one of the casings. A cam plate is mounted on a rotary shaft supported by the casings to reciprocate the piston. The cam plate is held by the casings between a pair of thrust bearings. Each of the casings has an adjoining surface opposed to the other and a member is sandwiched between the adjoining surfaces of the casings for absorbing dimensional tolerances of the casings, cam plate and thrust bearings according to its deformation.

Accordingly, the member located between the adjoining surfaces is deformed when the bolts are tightened to fasten the casings. This ensures absorption of the dimensional tolerances of the casings, cam plate, and thrust bearings.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of the present invention will now be described with reference to FIGS. 1 to 5.

Figure 1:
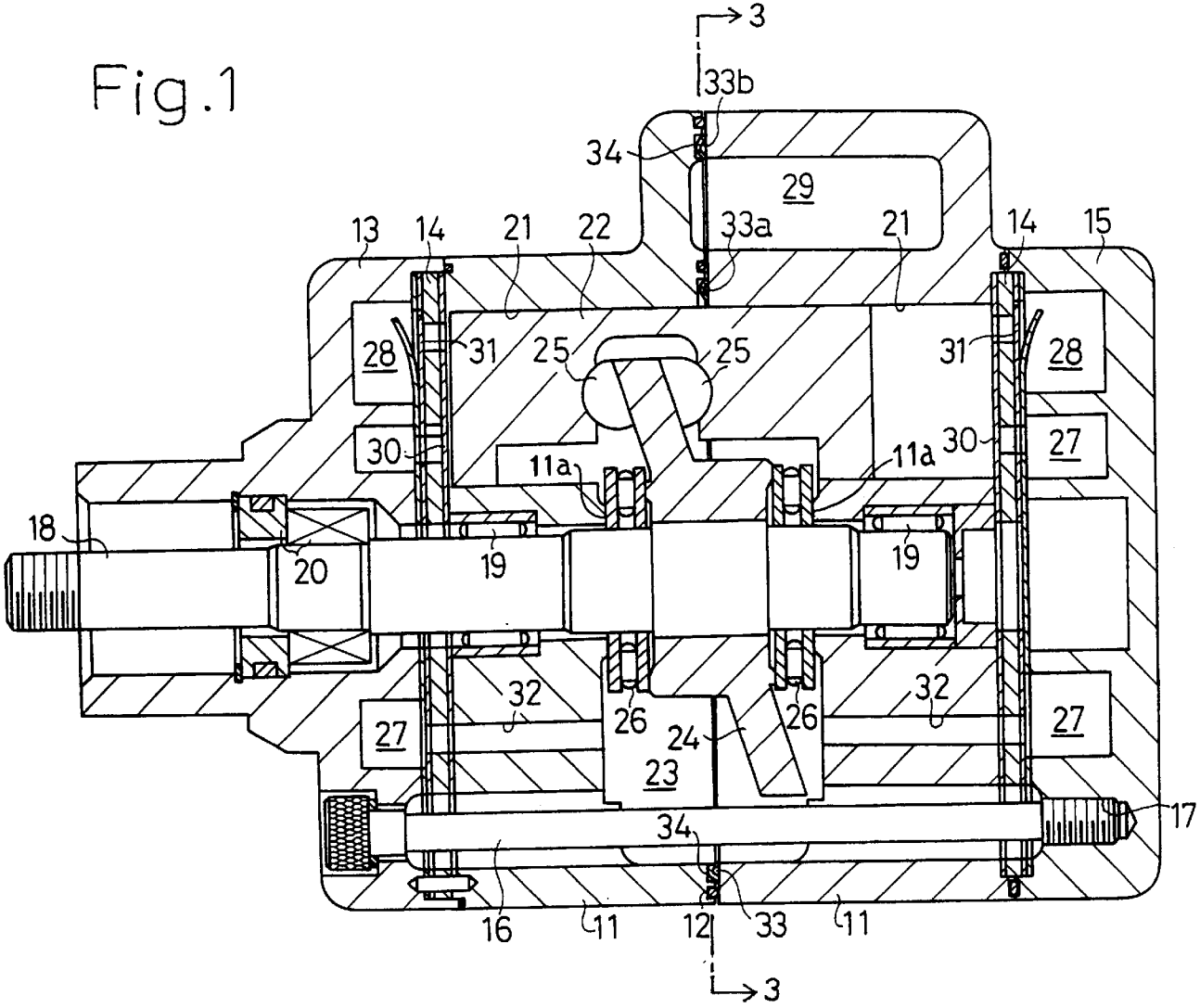
FIG. 1 is a cross-sectional side view showing a reciprocating piston type compressor according to the present invention.
Figure 3:
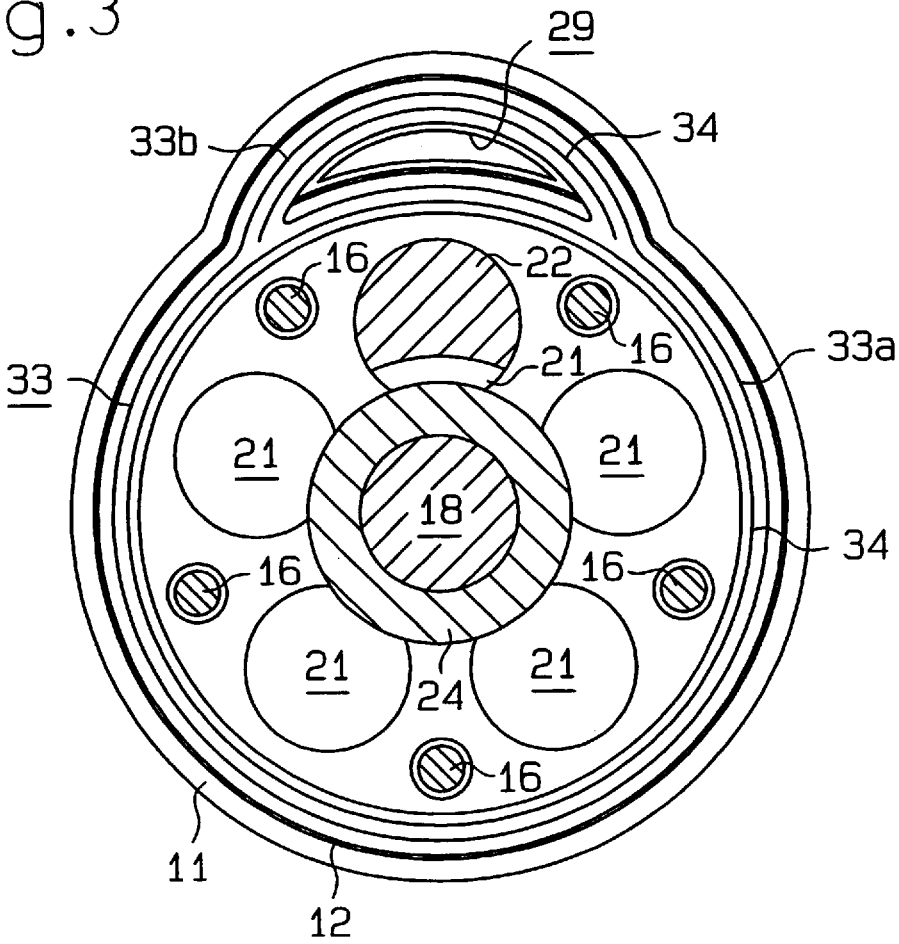
FIG. 3 is an end view of one of the compressor casings as seen from line 3—3 in FIG. 1, and showing an elastic member of the compressor shown in FIG. 1.

As shown in FIGS. 1 and 3, opposing ends of a pair of cylinder blocks 11 are coupled to each other with a seal ring 12 sandwiched in between. A front housing 13 is coupled to the front end face of the cylinder blocks 11 with a valve plate 14 located therebetween. A rear housing 15 is coupled to the rear end face of the blocks 11 with another valve plate 14 located therebetween. A plurality of bolts 16 are inserted through the front housing 13, the cylinder blocks 11, and the valve plates 14, and threaded into tapped holes 17. The bolts 16 fasten the front and rear housings 13, 15 to the face ends of the coupled blocks 11. A front casing is defined by a combination of the front housing 13 and the front block 11 and a rear casing is formed by the combination of the rear housing 15 and the rear block 11. Allowing for the projecting muffler 29 as will be described, or for similar variations, the respective opposing ends of the casings have corresponding substantially circular shapes providing annularly extending adjoining surfaces.

A rotary shaft 18 is rotatably supported by a pair of radial bearings 19 located respectively at the center of each of the cylinder blocks 11. A sealing device 20 is located between the rotary shaft 18 and the front housing 13. The rotary shaft 18 is driven by a drive source, such as an engine (not shown). A plurality of uniformly arranged cylinder bores 21 are formed extending parallel to the rotary shaft 18 within the blocks 11. A reciprocal double-headed piston 22 is located in each bore 21.

A swash plate chamber 23 is defined between the coupled blocks 11. A cam plate, or swash plate 24, is fixed to the rotary shaft 18 inside the plate chamber 23. The peripheral surface of the swash plate 24 is connected to the middle portion of each piston 22 by a pair of semi-spherical shoes 25. When the rotary shaft 18 is rotated, the swash plate 24 reciprocates the pistons 22. A pair of thrust bearings 26 is provided between the swash plate 24 and the inner wall 11*a* of each of the blocks 11. The swash plate 24 is clamped between the two blocks 11 by the thrust bearings 26. The coupled portion of the two blocks 11 is located between the two thrust bearings 26.

Annular suction chambers 27 are defined in the inner sections of the front and rear housings 13, 15. The suction chambers 27 are connected to an external refrigerant circuit (not shown) through a suction port. Annular discharge chambers 28 are defined in the outer sections of the front and rear housings 13, 15. A discharge muffler 29 is defined at an outer peripheral section of the two blocks 11 crossing or transversing (bridging) the coupled portion of the blocks 11. The muffler 29 suppresses pulsation of highly pressurized refrigerant gas when it is discharged into the external refrigerant circuit from the discharge chamber 28. A suction valve mechanism 30 is provided in each valve plate 14. The mechanism 30 allows refrigerant gas in the suction chambers 27 to be introduced into compression chambers defined by each bore 21. A discharge valve mechanism 31 is provided in each valve plate 14. The mechanism 31 allows the compressed gas in the compression chambers to be introduced into the discharge chambers 28.

A plurality of bleeding passages 32 extend through the blocks 11 and the valve plates 14 to connect both suction chambers 27 with the plate chamber 23. Blow-by refrigerant gas leaked from the bores 21 to the plate chamber 23 is returned to the suction chamber 27 through the bleeding passages 32 to suppress a pressure increase in the plate chamber 23.

Figure 2:
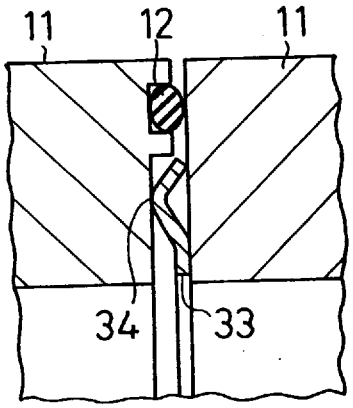
FIG. 2 is an enlarged view of a portion of the compressor shown in FIG. 1.

As shown in FIGS. 1 to 3, an elastic or resilient metal member 33 is provided between the coupled blocks 11. The member 33 is made of an elastic metal material. The member 33 has an annular main section 33*a* extending along between the adjoining surfaces of the blocks 11 the main section being a first resilient metal member, and an auxiliary section 33*b* providing a second metal member which is an extension of the main section 33*a* extending along and between the additional adjoining surfaces of the muffler 29. A resilient rail 34 an extends along the entire length of both sections 33*a*, 33*b*.

During assembly of this compressor, the bolts 16 are tightened to fasten the blocks 11 to each other with the swash plate 24 clamped between the blocks 11 by the thrust bearings 26. This deforms and flattens the member 33. Deformation of the member 33 absorbs the axial dimensional tolerances of the blocks 11, the swash plate 24, and the thrust bearings 26. Accordingly, a compressive load is applied to the swash plate 24, which rigidly holds the plate 24 between the blocks 11. This prevents generation of vibration and noise. In addition, the location of the member 33, aligned within an imaginary plane lying between the two thrust bearings 26, simultaneously absorbs the dimensional tolerances of the two bearings 26. Thus, this further ensures absorption of dimensional tolerance not only between the blocks 11 but also at the area encompassing the swash plate 24.

Furthermore, absorption of the dimensional tolerances by the member 33 prevents deformation of the races of the thrust bearings 26. Thus, the rotational resistance of the swash plate 24 with respect to the thrust bearings 26 is reduced. This also improves the durability of the bearings 26.

Figure 4:
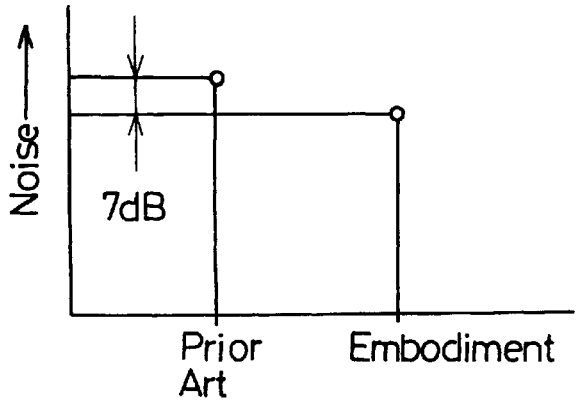
FIG. 4 is a graph showing experiment results comparing noise of the prior art compressor with noise of the compressor according to the present invention.

An experiment comparing the generated noise of a compressor according to this embodiment with that of a conventional compressor was conducted. The results are shown in FIG. 4. Both compressors were operated under the same conditions. Noise was measured from a position separated one meter from each compressor. The results show that the noise of the compressor according to the present embodiment was reduced by seven decibels in comparison with the prior art compressor.

In the present invention, dimensional tolerances are sufficiently absorbed by a simple structure in which the elastic member 33 is sandwiched between the adjoining surfaces of the blocks 11. Thus, selecting various swash plates 24, cylinder blocks 11, and thrust bearings 26, having different axial dimensions, during assembly to offset the dimensional tolerances between each component is not required. Consequently, this decreases the time required for assembly and a reduction in manufacturing costs.

The outer dimensions of the bolts 16, used in the compressor shown in FIG. 1, are determined such that they plastically deform when the blocks 11 reach a predetermined tightened state. As each bolt 16 is tightened and reaches the predetermined tightened state, plastic deformation, caused by torsion applied to the bolt 16, absorbs the excessive tightening force afterward. Referring to the graph shown in FIG. 5, the double-dotted line indicates the relationship between stress and strain acting when torsion is applied to the bolt 16. The solid line indicates the relationship between stress and strain acting when tension is applied to the bolt 16.

Figure 5:
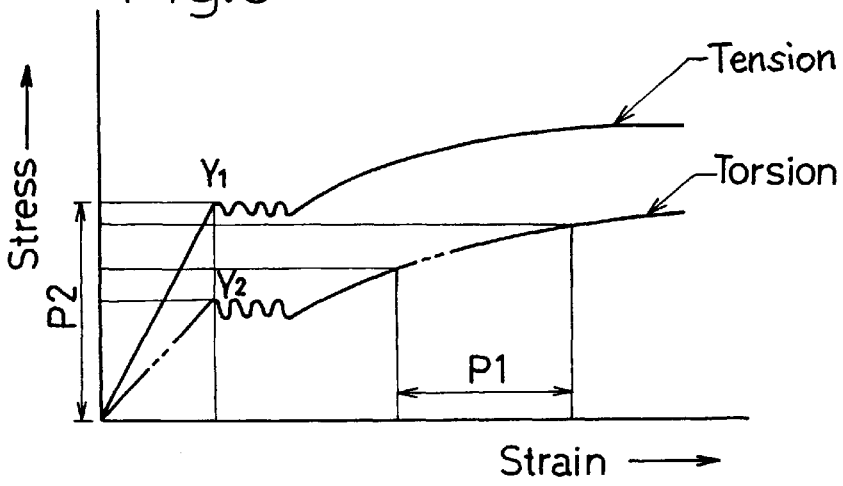
FIG. 5 is a graph showing the relationship between stress and strain of a bolt.

Stress and strain of torsion and stress and strain of tension produced when tightening the bolt 16, with the swash plate 24 clamped between the blocks 11 by the thrust bearings 26, varies as shown by the two characteristic curves of FIG. 5. Elastic deformation in the bolt 16 occurs until tension reaches yield point Y1, and torsion reaches yield point Y2. Stress and strain are proportional to each other in this deformation range. When stress reaches the yield points Y1, Y2, the change in stress with respect to strain becomes small indicating plastic deformation in the bolt 16.

In the present invention, tightening of the bolt 16 is completed after dimensional tolerances are absorbed by deformation of the elastic member 33 and when stress of torsion reaches a plastic deformation range P1 in which the change in stress with respect to strain is substantially flat. When the tightening is completed, application of force in the torsion direction is terminated. In this state, tension is in a deformation range P2. The compressor is thus rigidly assembled with an appropriate tightening force applied to the bolts 16, which are maintained in a state having sufficient strength.

Accordingly, an increase in power consumption and a degradation in the reliability of the thrust bearings 26, which may occur when a large amount of load is applied to the thrust bearings 26 in the axial direction during tightening of the bolts 16, is prevented. Furthermore, generation of vibration and noise, caused by insufficient tightening of the bolts 16 and insufficient engagement between the threads of the bolt 16 and the associated threaded hole 17, is prevented.

Figure 6:
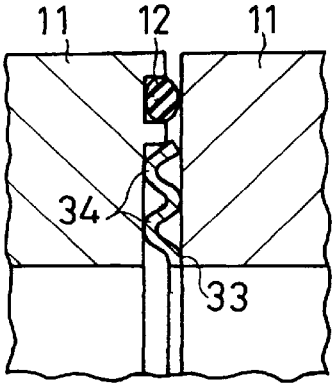
FIG. 6 is an enlarged, partial cross-sectional view showing a modification of the compressor.

A modification of the embodiment described above is shown in FIG. 6. Two rails 34 are projected from the surface of the elastic member 33. In this modification, the two rails 34 result in the member 33 being effectively deformed when the bolts 16 are tightened. Accordingly, this further ensures absorption of the axial dimensional tolerances of the cylinder block 11, the swash plate 24, and the thrust bearings 26.

Although only two embodiments of the present invention has been described, it should be apparent to those skilled in the art that the present invention may be embodied in many other specific forms without departing from the spirit or scope of the invention. Particularly, it should be understood that the present invention may also be modified as described below.

(a) The outer dimension of a section of each bolt 16 may be narrowed to enable plastic deformation at the narrowed section.

(b) A member having more than two resilient rails projecting from its surface may be employed as the elastic member 33.

Figure 7:
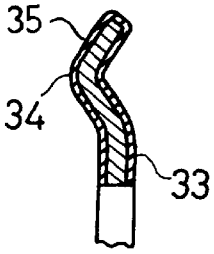
FIG. 7 is an enlarged, partial cross-sectional view showing another modification of the compressor.

(c) As shown in FIG. 7, an elastomeric coating 35, such as rubber, may be applied to the elastic member 33 to add a sealing function to the member 33. In this case, a seal ring 12 sealing the coupled portion of the cylinder blocks 11 may be omitted.

(d) The present invention may be employed in a single-headed reciprocal piston type compressor.

Therefore, the present examples and embodiments are to be considered as illustrative and not restrictive and the invention is not to be limited to the details given herein, but may be modified within the scope of the appended claims.

What is claimed is:

1. A reciprocating piston type compressor having a pair of cofacing casings fastened together by a plurality of tightenable bolts, a cylinder bore formed in at least one of the casings, a piston disposed within said bore for reciprocation therein, a cam plate coupled thereto for reciprocating said piston, said cam plate being mounted on a rotatable shaft which is supported by and extends between said casings, a pair of thrust bearings mounted on said shaft, one thrust bearing on each side of said cam plate between said cam plate and the adjacent casing, said casings each having a radially inner portion with an annular end surface engaging an adjacent thrust bearing and a radially outer axially projecting potion with an annular end surface, said annular end surfaces of said radially outer axially projecting portions facing each other with a continuous gap therebetween when said bolts are tightened to clamp said thrust bearings and cam plate between said end surfaces of said radially inner portions of said casings, a resilient elastically compressible metal member conforming to the contour of said annular end surfaces of said outer axially projecting portions sandwiched under elastic compression between said annular end surfaces to thereby absorb axial dimensional tolerances between said casings, said swash plate and said thrust bearings and provide predetermined tightened stress on said thrust bearings, said resilient member being corrugated annularly and dimensioned relative to said gap to fit in said gap under less than completely flattened condition for all variations in the dimension of said gap due to tolerance variations, and elastically compressible scaling means disposed in said gap to provide a fluid seal therebetween, said annular end surfaces of said radially outer axially projecting portions of said casings engaging only said elastically compressible member and elastically compressible means within their compressible ranges.

2. The compressor according to claim 1, wherein said annular end surfaces of said casings have at least a circular area, and said resilient metal member has at least a circular area corresponding to said circular area of said end surfaces of said casings, and a circular corrugation extending around said circular area of said resilient member.

3. The compressor according to claim 2, wherein said circular corrugation has a pair of parallel crests separated by a valley.

4. The compressor according to claim 1, wherein said means to provide a fluid seal comprises an elastomeric coating over at least those portions of said resilient metal member that contact said end surfaces of said casings when said bolts are tightened.

5. The compressor according to claim 1, wherein said end surfaces of said casings are located in imaginary planes that lie between said pair of thrust bearings.

6. The compressor according to claim 1, wherein said bolts are each plastically deformable in response to applied torsion and applied tension where the yield point for applied torsion is at a lower stress than the yield point for applied tension, and said bolts are tightened beyond said torsion yield point and below said tension yield point.

7. The compressor according to claim 1, further comprising:

a discharge chamber defined in each casing for receiving a refrigerant gas compressed in the cylinder bore;

a discharge muffler formed in the casings so as to traverse said end surfaces of said casings for suppressing pulsation of said refrigerant gas when the refrigerant gas is delivered from said discharge chamber, said discharge muffler having a portion in each casing and having respective additional spaced apart surfaces forming respective radially outward extensions of said annular end surfaces of said casings merging with the latter at circumferentially spaced apart locations; and an extension segment of said resilient metal member sandwiched between said additional spaced apart surfaces of said discharge muffler.

8. The compressor according to claim 7, wherein said resilient metal member including said extension segment have an elastomeric coating thereon.

9. The compressor according to claim 7, wherein said means to provide a fluid seal comprises a seal ring sandwiched between and along said end surfaces of said casings including said respective radially outward extensions, said seal ring being in annularly parallel adjacent relation to said resilient metal member including said extension segment for sealing the fastened pair of casings including said discharge muffler by sealing the gap therebetween.

10. The compressor according to claim 1, wherein said means to provide a fluid seal comprises an annular seal ring located radially outward of said resilient metal member between said end surfaces of said casings for sealing the inside of said casings by sealing the gap therebetween.

11. The compressor according to claim 1, wherein said means to provide a fluid seal comprises a seal ring sandwiched between and along said end surfaces of said casings in annularly parallel adjacent relation to said resilient metal member for sealing the fastened pair of casings by sealing the gap therebetween.

12. A reciprocating piston type compressor having a pair of cofacing casings fastened together by a plurality of tightenable bolts, a plurality of cylinder bores formed in the casings, a plurality of double-headed pistons disposed within said bores for reciprocation therein, and a cam plate coupled thereto for reciprocating said pistons, said cam plate being mounted on a rotatable shaft which is supported by and extends between said casings, wherein said cam plate is held by said casings between a pair of thrust bearings, each one of said thrust bearings within a respective one of said pair of casings, said casings each having a radially inner portion with an annular end surface engaging an adjacent thrust bearing and a radially outer axially projecting portion with an annular end surface, said annular end surfaces of said radially outer axially projecting portions facing each other with a continuous gap therebetween when said bolts are tightened to clamp said thrust bearings and cam plate between said end surfaces of said radially inner portions of said casings, a resilient elastically compressible metal member conforming to the contour of said annular end surfaces of said outer axially projecting portions sandwiched under elastic compression between said annular end surfaces to thereby absorb axial dimensional tolerances between said casings, said swash plate and said thrust bearings and provide predetermined tightened stress on said thrust bearings, said resilient member being annularly corrugated and dimensioned relative to said gap to fit in said gap under less than completely flattened condition for all variations in the dimension of said gap due to tolerance variations, and elastically compressible sealing means disposed in said gap to provide a fluid seal therebetween, said annular end surfaces of said radially outer axially projecting portions of said casings engaging only said elastically compressible member and elastically compressible means within their compressible ranges.

13. The compressor according to claim 12, wherein said annular end surfaces of said casings have at least a circular area, and said resilient metal member has at least a circular area corresponding to said circular area of said end surfaces of said casings, and a circular corrugation extending around said circular area of said resilient member.

14. The compressor according to claim 12, wherein said means to provide a fluid seal comprises an elastomeric coating over at least those portions of said resilient metal member that contact said end surfaces of said casings when said bolts are tightened.

15. The compressor according to claim 12, wherein said circular corrugation has a pair of parallel crests separated by a valley.

16. The compressor according to claim 12, wherein said end surfaces of said casings are located in imaginary planes that lie between said pair of thrust bearings.

17. The compressor according to claim 12, wherein said bolts are each plastically deformable in response to applied torsion and applied tension where the yield point for applied torsion is at a lower stress than the yield point for applied tension, and said bolts are tightened beyond said torsion yield point and below said tension yield point.

18. The compressor according to claim 12, further comprising:

a discharge chamber defined in each casing for receiving a refrigerant gas compressed in the cylinder bores;

a discharge muffler formed in the casings so as to traverse said end surfaces of said casings for suppressing pulsation of said refrigerant gas when the refrigerant gas is delivered from said discharge chamber, said discharge muffler having a portion in each casing and having respective additional spaced apart surfaces forming respective radially outward extensions of said annular end surfaces of said casings merging with the latter at circumferentially spaced apart locations; and an extension segment of said resilient metal member sandwiched between said additional spaced apart surfaces of said discharge muffler.

19. The compressor according to claim 18 further comprising an annular seal ring located radially outward of said resilient metal member between said end surfaces of said casings for sealing the inside of said casings by sealing the gap therebetween.

20. The compressor according to claim 18, wherein said resilient metal member including said extension segment have an elastomeric coating thereon.

* * * * *

UNITED STATES PATENT AND TRADEMARK OFFICE
CERTIFICATE OF CORRECTION

PATENT NO. : 6,030,184

DATED : February 29, 2000

INVENTOR(S) : Hayato IKEDA et al.

It is certified that error appears in the above-identified patent and that said Letters Patent is hereby corrected as shown below:

Column 3, line 17, after "blocks 11." insert the sentence:

--The muffler 29 has respective additional adjoining surfaces forming respective extensions of the adjoining surfaces of the blocks 11.–

Column 3, line 38, after "along" and before "between" insert --and--.

Column 3, line 41, after "second" and before "metal" insert --resilient--.

Column 3, line 42, after "33a" and before "extending" insert --and--.

Column 3, line 44, after "34" delete "an" and insert --projects and--.

Column 5, line 37, after "projecting" change "potion" to --portion--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*